US008408022B2

(12) United States Patent
Stockton, Jr.

(10) Patent No.: US 8,408,022 B2
(45) Date of Patent: Apr. 2, 2013

(54) HYBRID CASCADE VAPOR COMPRESSION REFRIGERATION SYSTEM

(76) Inventor: Harold E. Stockton, Jr., Round Rock, TX (US)

( * ) Notice: Subject to any disclaimer, the term of this patent is extended or adjusted under 35 U.S.C. 154(b) by 980 days.

(21) Appl. No.: 12/411,175

(22) Filed: Mar. 25, 2009

(65) Prior Publication Data

US 2010/0242534 A1 Sep. 30, 2010

(51) Int. Cl.
*F25D 21/14* (2006.01)

(52) U.S. Cl. ..... 62/291; 62/506

(58) Field of Classification Search ..... 62/289, 62/288, 272, 291, 335, 498, 506; 165/181, 165/104.22
See application file for complete search history.

(56) References Cited

U.S. PATENT DOCUMENTS

| | | | | | |
|---|---|---|---|---|---|
| 1,890,205 | A | | 1/1931 | Andresen | |
| 2,249,882 | A | | 7/1941 | Buchanan | |
| 3,938,352 | A | | 2/1976 | Schmidt | |
| 4,280,334 | A | * | 7/1981 | Lakdawala | 62/277 |
| 4,938,035 | A | * | 7/1990 | Dinh | 62/279 |
| 5,113,668 | A | * | 5/1992 | Wachs et al. | 62/305 |
| 5,797,277 | A | * | 8/1998 | Hong et al. | 62/285 |
| 5,979,172 | A | | 11/1999 | Teller | |
| 6,006,541 | A | | 12/1999 | Taylor | |
| 6,305,188 | B1 | * | 10/2001 | Park | 62/513 |
| 6,393,850 | B1 | * | 5/2002 | Vanderstraeten | 62/196.3 |
| 6,408,612 | B2 | * | 6/2002 | Hannemann et al. | 60/39.12 |
| 6,698,221 | B1 | * | 3/2004 | You | 62/196.4 |
| 6,845,738 | B2 | * | 1/2005 | Frutschi | 123/25 C |
| 7,013,658 | B2 | * | 3/2006 | Dobmeier et al. | 62/150 |
| 2001/0015059 | A1 | * | 8/2001 | Fetescu et al. | 60/39.02 |
| 2001/0023579 | A1 | * | 9/2001 | Hannemann et al. | 60/39.12 |
| 2001/0042377 | A1 | * | 11/2001 | Pozivil | 62/48.3 |
| 2002/0139137 | A1 | * | 10/2002 | Tipton | 62/498 |
| 2002/0157404 | A1 | * | 10/2002 | Pauwels | 62/84 |
| 2004/0089015 | A1 | * | 5/2004 | Knight et al. | 62/324.1 |
| 2004/0112601 | A1 | * | 6/2004 | Hache | 166/302 |
| 2004/0144118 | A1 | | 7/2004 | Hebert | |

* cited by examiner

*Primary Examiner* — Mohammad Ali
(74) *Attorney, Agent, or Firm* — Rader, Fishman & Grauer, PLLC

(57) ABSTRACT

An exemplary system includes a first heat exchanger immediately after the compressor that provides direct, conduction-based cooling with condensate recovered from the evaporator. A second heat exchanger cools the forced air that passes over the condenser by evaporating recovered condensate, rainwater, and/or city water into the air as it passes through a breathable water-retaining medium. Finally, a third heat exchanger is described that utilizes recovered condensate, rainwater, and/or city water within an insulated enclosure to obtain additional cooling before the condensed refrigerant enters the expansion valve. Various alternative embodiments are described that include variations of each of these heat exchangers. Additionally, several alternative placements of the heat exchangers are disclosed.

17 Claims, 8 Drawing Sheets

HYBRID CASCADE VAPOR COMPRESSION REFRIGERATION SYSTEM

TECHNICAL FIELD

The present system and method relates to refrigeration and cooling systems. More specifically, the present system and method relates to methods of cooling the compressor and refrigerant within a vapor compression refrigeration system.

BACKGROUND

Carnot cycle systems are commonly used as heat transfer machines allowing one room or volume to be cooled as another is heated. There have been continuous attempts to improve the efficiency of Carnot cycle refrigeration machines. Many refrigeration devices utilize a hermetically sealed compressor that requires special cooling so as to not overheat during operation.

Vapor-compression refrigeration has been widely used as a method for air-conditioning large public buildings, private residences, hotels, hospitals, theaters, restaurants, and automobiles. It is also used in domestic and commercial refrigerators, large-scale warehouses for storage of foods and meats, refrigerated trucks and railroad cars, and a host of other commercial and industrial services. Oil refineries, petrochemical and chemical processing plants, and natural gas processing plants are among the many types of industrial plants that often utilize large vapor compression refrigeration systems.

All such systems have four basic components: a compressor, a condenser, an expansion valve, and an evaporator. To begin the refrigeration cycle within a vapor compression refrigeration system, circulating refrigerant enters the compressor in a thermodynamic state known as a "saturated vapor." A saturated vapor is a vapor at its saturation temperature and pressure. In other words, a saturated vapor is a vapor whose temperature and pressure are such that any compression of its volume at constant temperature causes it to condense to liquid at a rate sufficient to maintain a constant pressure. The saturated vapor is compressed in a compressor to a higher pressure, resulting in an increase in temperature of the refrigerant. The hot, compressed refrigerant enters the thermodynamic state known as a "superheated vapor." A superheated vapor is a vapor that is at a temperature higher than the saturation temperature corresponding to its pressure. In other words, the superheated vapor is at a temperature and pressure at which it can be condensed with, for example, ambient air or a cooling fluid such as water. In most systems, the hot, compressed vapor is routed through a condenser where it is cooled and condensed into a liquid as it flows through a coil or tubes with cool water or cool air flowing across the coil or tubes. It is within the coil or tubes where the circulating refrigerant rejects heat from the system (i.e. away from the space to be cooled).

The condensed liquid refrigerant, now in the thermodynamic state known as a saturated liquid, is next routed through an expansion valve where it undergoes an abrupt reduction in pressure. A saturated liquid is a liquid at its saturation temperature and saturation pressure. In other words, a saturated liquid is a liquid whose temperature and pressure are such that any decrease in pressure without change in temperature causes it to boil. The pressure reduction caused by the expansion valve results in the adiabatic flash evaporation of a part of the liquid refrigerant. The auto-refrigeration effect of the adiabatic flash evaporation lowers the temperature of the liquid and vapor refrigerant mixture to where it is colder than the temperature of the enclosed space to be cooled.

The cold mixture is then routed through the coil or tubes in the evaporator. A fan circulates the warm air in the enclosed space across the coil or tubes carrying the cold refrigerant liquid and vapor mixture. That warm air evaporates the liquid part of the cold refrigerant mixture. At the same time, the circulating air is cooled and thus lowers the temperature of the enclosed space. The evaporator is where the circulating refrigerant absorbs and removes heat, which is subsequently rejected in the condenser and transferred elsewhere by the water or air used in the condenser.

Finally, the refrigeration cycle is completed as the refrigerant from the evaporator is again routed back into the compressor. The cycle begins again as the circulating refrigerant enters the compressor.

Various devices and methods have been developed to cool hermetically sealed compressors. Many previous attempts utilize either a portion of the returning cool refrigerant or an additional heat exchanger specifically designed to cool the compressor. Alternative methods include cooling the hot exhaust gas exiting the compressor, cooling the condenser coil assembly, and utilizing the returning cool refrigerant to cool the warm liquid refrigerant as it exits the condenser coil assembly.

An alternative attempt to cool the compressor including cooling the compressor's lubricating oil. This has been done by diverting cold evaporative gases through a cooling loop built into the bottom of the compressor. However, while this extends the life of the compressor, warmer evaporated gases are then fed back into the refrigeration cycle for compression. However, methods utilizing the returning cold evaporated gases to cool portions of the system, including the compressor, add heat to the overall system and result in less efficient cooling.

Similar attempts to cool the compressor include pumping the compressor's lubricating oil through a system of tubes to an external heat exchanger where ambient air cools the oil before it returns to the compressor. Though this does not add heat to the cold evaporative gases, the relative cooling efficiency is minimal and very dependent on the fin area of the external heat exchanger. As the temperature of the ambient air within such casings often reaches temperatures between 120° F. to 140° F., the amount of cooling achieved by such heat exchangers is minimal at best.

In another more recent attempt, a portion of the cold evaporative gases is diverted to cool the casing of the hermetically sealed compressor. However, this also adds heat to the cold evaporative gases, significantly reducing the overall efficiency of the whole refrigeration process. In fact using the cold evaporative gases to cool other portions of the system can reduce overall efficiency by as much as 20%.

The prior art allows a significant decrease in efficiency in order to prolong the life of the compressor by lowering its operating temperature. As previously mentioned many of these systems utilize the returning cold evaporative gases to cool either the compressor itself or to cool the hot gas emitted from the compressor before they enter the condenser.

Many alternative systems fail to reach maximum efficiency because they attempt to gain more cooling than is available through auxiliary and additional heat exchangers. For example, condensate recovered from the evaporative portion of the Carnot system is used to remove heat from the hot gases. However, many prior art systems attempt to use the condensate to cool more than just the hot gas emitted from the compressor. Prior art systems attempt to use the condensate to cool the gases at many locations in the system, such as before and after the condenser. While this is done in an attempt to exploit all the heat-absorbing capabilities of the recovered condensate, the result is that the condensate becomes too hot. Consequently, the heat removed before the condenser is reintroduced back into the system after the condenser.

In sum, large quantities of condensate formed on the evaporator must be either drained or evaporated by hot sections of the Carnot cycle. Prior art devices utilizing the returning cold evaporative gases to cool the compressor are extremely inefficient. Other methods over-utilize recovered condensate and thereby reintroduce heat back into the system. Finally, prior art systems attempting to address these issues are complex and require replacement or significant modification of existing refrigeration machines. The present system and method provides several novel methods of cooling the compressor and refrigerant of a Carnot system, including methods that efficiently use condensate recovered from the evaporator.

SUMMARY

According to one exemplary embodiment of the present system and method the section of pipe immediately following the compressor of a vapor compression refrigeration system is cooled with a first heat exchanger. According to one exemplary embodiment, the section of pipe is cooled utilizing condensate recovered from the evaporator of the refrigeration system. According to one embodiment, this first heat exchanger includes a second stage where city water or recovered rainwater supplements the recovered condensate in the event additional cooling is desired or needed.

According to one embodiment, this first heat exchanger comprises a water-retaining medium surrounding the section of pipe immediately following the compressor. Recovered condensate is supplied to the water-retaining medium through one or more drip nozzles allowing between one and ten gallons per hour to enter the water-retaining medium. Likewise, a second stage of the first heat exchanger supplies either city water or collected rainwater through drip nozzles into the water-retaining medium.

According to another embodiment, the vapor compression refrigeration system includes a second heat exchanger in which recovered condensate, rainwater, and/or city water is drip-fed into a breathable medium. Before air is forced over the condenser it passes through the breathable medium and evaporates the drip fed-water, thereby cooling the air before it passes over the condenser. Consequently, the cooled air absorbs more heat from the compressed vapor within the condenser.

According to another embodiment, a third heat exchanger is utilized wherein recovered condensate, rainwater, and/or city water is directed into an insulated enclosure. According to this exemplary embodiment, the heat exchanger comprises an insulated enclosure encapsulating sections of coiled pipe. Entering water absorbs heat from the condensed refrigerant within the coils. The warm refrigerant is further cooled and directed out of the insulated enclosure. According to one exemplary embodiment, this third heat exchanger replaces the first heat exchanger and cools the section of pipe immediately following the compressor. According to another embodiment, the third heat exchanger immediately follows the condenser and acts to cool the warm refrigerant even further before it enters the expansion valve.

Various embodiments are described incorporating one or more of the three heat exchangers into a typical vapor compression refrigeration system. Several embodiments are described utilizing one or more of the three heat exchangers in various configurations and in various locations throughout vapor compression refrigeration systems.

According to various embodiments, by cooling the section of pipe immediately following the compressor the need to cool hermetically sealed and piston-type compressors is fulfilled. The heat exchangers relieve the pressure and heat normally present on the compressor assembly. This reduces the energy requirements for the same volumetric capacity of the unmodified refrigeration system. This also translates to an increased temperature differential capacity of the system's evaporator coil, allowing for colder airflow while using less energy.

Additional embodiments of the present system and method are described below as well as various configurations that allow for greater efficiency and longer system life.

BRIEF DESCRIPTION OF THE DRAWINGS

The accompanying drawings illustrate various embodiments of the principles described herein and are a part of the specification. The illustrated embodiments are merely examples and do not limit the scope of the disclosure. Throughout the drawings, identical reference numbers designate identical or similar elements.

Figure 1:
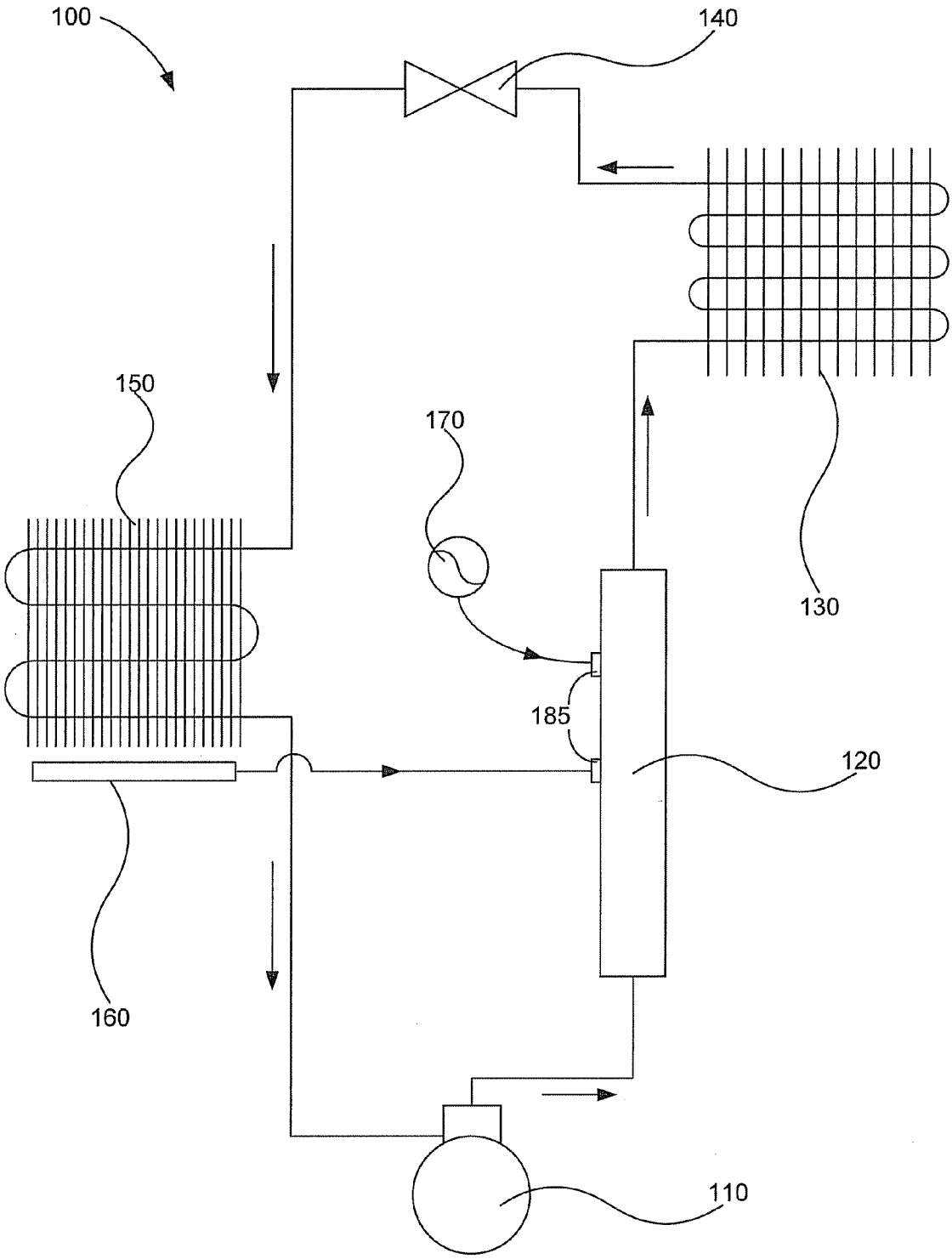
FIG. 1 is a schematic illustrating a vapor compression cycle including a two-stage heat exchanger immediately following the compressor, according to one exemplary embodiment.

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape or the relative position of the particular elements, and have been solely selected for ease of recognition in the drawings. Throughout the drawings, identical reference numbers designate similar but not necessarily identical elements.

DETAILED DESCRIPTION

This specification describes several heat exchangers that improve the efficiency of standard vapor compression refrigeration systems. Specifically, a heat exchanger is described that reduces the temperature of the compressor in a vapor compression refrigeration system. The present method of reducing the temperature of the compressor is different from prior art attempts in that the present system and method is adaptable for use on existing systems. Furthermore, the present system and method provides a heat exchanger that is insulated from the ambient air within the refrigeration system. Many prior art systems utilize recovered condensate to cool portions of a refrigeration system. However, prior art systems attempt to gain additional cooling with the condensate, and consequently reintroduce the heat back into the system. According to one embodiment, the present system provides superior efficiency in that all recovered condensate is super-heated and boiled off. By not overusing the condensate, absorbed heat is never reintroduced into the system and consequently the present system and method achieves greater efficiency.

A first heat exchanger is described that is configured to surround and cool a section of pipe utilizing recovered condensate in a first stage of cooling. A second stage of the first heat exchanger utilizes rainwater and/or city water to further cool the section of pipe. According to various embodiments, this first heat exchanger can be installed and configured easily onto existing refrigerant systems. According to various embodiments, this first heat exchanger is drip-fed with water that directly absorbs heat through conduction.

A second heat exchanger is described herein that interacts with the forced air traditionally used to cool the condenser. Traditional systems use fans to force air over a series of coils and fins, and thereby cool the vapor within the system. According to one embodiment, a breathable medium is drip-fed water from one or more sources. As the air from the fan is forced through the breathable medium the air will be cooled as the water is evaporated. This water-cooled air provides additional and more efficient cooling of the condenser.

A third heat exchanger is described that includes a water-fed insulated enclosure. Compressed refrigerant enters the enclosure and passes through a series of coils. According to various embodiments, fins extending from the coils allow for more efficient heat transfer. Cold water entering the enclosure absorbs heat from the refrigerant within the coils and is subsequently diverted from the enclosure. According to various embodiments this third heat exchanger may be placed before or after the condenser. The insulated enclosure provides for a more efficient heat exchanger because the hot ambient air within the refrigeration system does not adversely affect the heat transfer.

In the following description, certain specific details are set forth in order to provide a thorough understanding of various embodiments of the present vapor compression refrigeration system and method. However, one skilled in the relevant art will recognize that the present exemplary system and method may be practiced without one or more of these specific details, or with other methods, components, materials, etc. In other instances, well-known structures associated with refrigeration systems have not been shown or described in detail to avoid unnecessarily obscuring descriptions of the present exemplary embodiments.

Unless the context requires otherwise, throughout the specification and claims which follow, the word "comprise" and variations thereof, such as, "comprises" and "comprising" are to be construed in an open, inclusive sense, that is, as "including, but not limited to."

Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment. Furthermore, the particular features, structures, or characteristics may be combined in any suitable manner in one or more embodiments.

Finally, while three distinct heat exchangers are described, one of ordinary skill in the art will recognize that each of them may be positioned anywhere within a traditional vapor compression refrigeration system. Additionally, any one of the described heat exchangers may be used in conjunction with either of the other heat exchangers. It is also conceivable to combine features of one heat exchanger with those of another. For example, it may be desirable to insulate the first each exchanger, or to provide cold-water saturated forced air into an insulated enclosure. The following specific details of the present system and method provide a thorough understanding of various embodiments of the present vapor compression refrigeration system and method. However, many variations are possible and are likely to be used in practice to obtain maximum efficiency within a vapor compression refrigeration system.

Exemplary System

FIG. 1 illustrates a vapor compression refrigeration system (100) modeled after typical Carnot systems. The refrigeration system exemplified in FIG. 1 includes a compressor (110) that compresses refrigerant within the system (100). Any of various nonflammable fluorocarbons or other refrigerants may be used in the present system and method. Ideally the refrigerant enters the compressor (110) as a saturated vapor. As the compressor (110) compresses the saturated vapor, the vapor increases in temperature and enter a thermodynamic state known as superheated vapor. The extreme pressures and heat created by the compressor (110) significantly reduce the life of the compressor (110). Furthermore, as the entire refrigeration process depends on the eventual cooling of this superheated vapor, the present system and method presents a novel method of cooling the vapor immediately following the compressor (110). A first heat exchanger (120) utilizes condensate recovered from the evaporator in its first stage and rain or city water in a second stage. This first heat exchanger (120) provides significant cooling of the superheated vapor immediately after the compressor (110) and significantly reduces the temperature and pressure of the compressor (110). In addition to prolonging the life of the compressor (110), the first heat exchanger increases the overall efficiency of the system by cooling the superheated vapor before it enters the condenser (130).

As is described in detail below, this first heat exchanger (120) can be used with existing refrigeration systems. The first heat exchanger (120) provides significant advantages over prior art methods of cooling the superheated vapor before it enters the condenser (130). Cooling the refrigerant between the compressor and the condenser is typically termed "pre-cooling" in the prior art and is often done by pumping and evaporating recovered condensate or supplemental water into air as it passes over coils. The prior art effectively pre-cools the superheated vapor by adding a second condenser, differing only from traditional condensers in that water is evaporated into the forced air. The present system and method utilizes a water-retaining medium (see FIG. 4) that allows drip-fed recovered condensate to come into direct contact with the pipe containing superheated vapor. As the superheated vapor contacts the condensate, the condensate is flash-evaporated. Through conduction, rather than convection as in the prior art, the cold condensate absorbs a maximum amount of heat from the superheated vapor before being expelled from the system.

Continuing with FIG. 1, the now slightly cooler superheated vapor enters the condenser (130) and transitions to a thermodynamic state known as saturated liquid as it is cooled. The saturated liquid then enters the expansion valve (140) and experiences an abrupt reduction in pressure. The pressure reduction caused by the expansion valve (140) results in an adiabatic flash evaporation of the liquid refrigerant. Air forced over the evaporator (150) is cooled because the cool refrigerant within. The cycle is complete. Heat is absorbed by the refrigerant in the evaporator (150) and subsequently rejected as the refrigerant passes through the condenser (130). As the refrigerant continues to cycle through the system, the volume associated with the evaporator (150) becomes cooler and the volume associated with the condenser (130) becomes warmer.

As illustrated in FIG. 1, as air passes over the evaporator (150) condensate will form on the evaporator (150). This extremely cold condensate is recovered by a tray (160) and is then fed through a one gallon per hour dripper (185) into the first heat exchanger (120). Alternative embodiments utilize drip speeds of significantly more than one gallon per hour or a multiplicity of drippers.

Additionally as is illustrated in FIG. 1, according to one exemplary embodiment, the first heat exchanger (120) includes a second stage in which rainwater and/or city water (170) is fed into the heat exchanger (120) through similar drippers (185). In sum, a traditional Carnot cycle based vapor compression refrigerant system is supplemented by a first heat exchanger (120) that uses recovered (160) condensate, rainwater, and/or city water (170) to pre-cool the superheated vapor. The present system and method accomplishes this in the most efficient manner by introducing the cold water into direct contact with the superheated vapor pipes. Not only does this significantly improve the efficiency of the overall system (100), it also extends the life of the compressor by reducing the internal temperature and pressure.

Figure 2:
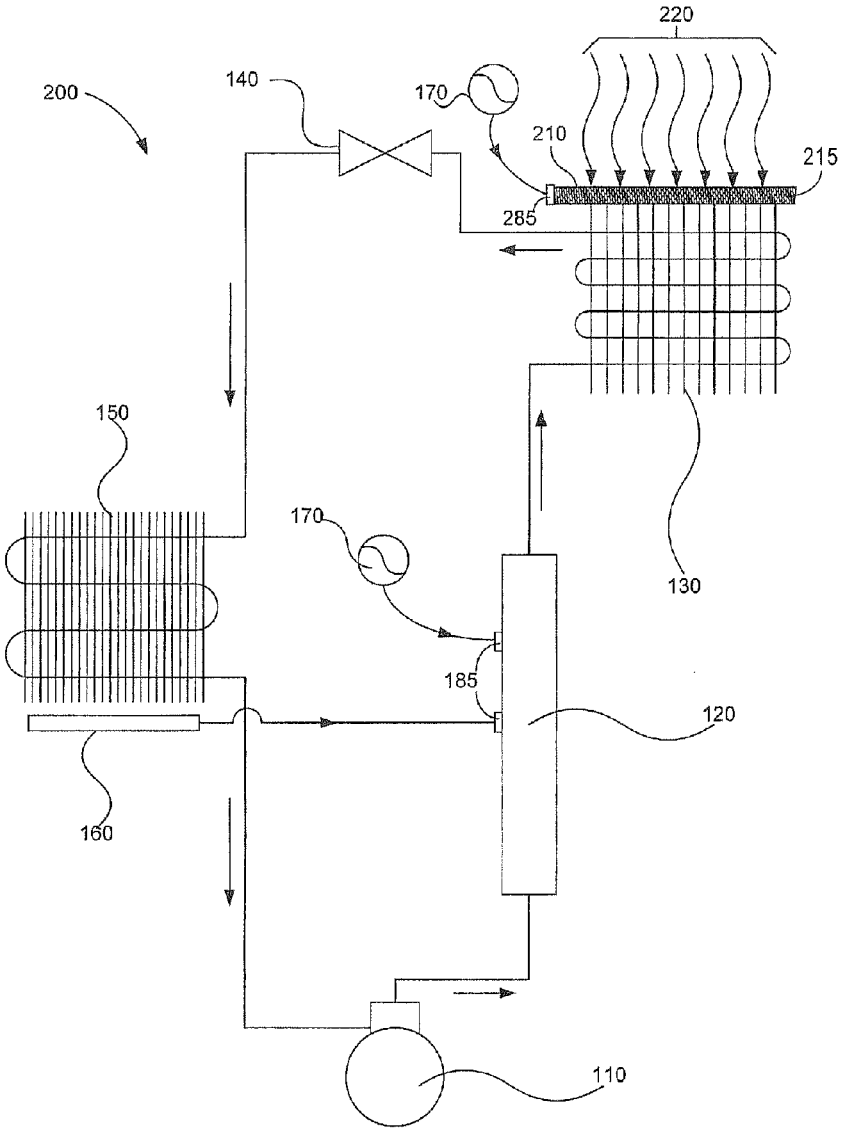
FIG. 2 is a schematic illustrating a vapor compression cycle including a two-stage heat exchanger prior to the condenser as well as a convection heat exchanger on the condenser, according to one exemplary embodiment.

FIG. 2 illustrates another embodiment of the present system and method. According to this exemplary embodiment, the system (100) described in conjunction with FIG. 1 is configured with a second heat exchanger (210) that provides for additional cooling of the condenser (130). So as not to redundantly describe the present system, all the elements of FIG. 2 that are identical to those of FIG. 1 are not described a second time. The second heat exchanger (210) comprises of a breathable water-retaining medium 215. In a traditional system air is forced (220) over the coils and fins of a condenser (130). According to one embodiment of the present system and method, air (220) passes through a breathable medium (215) before passing over the fins and coils of the condenser (130). The breathable medium (215) is injected with recovered condensate, rainwater and/or city water (170) via one or more injector or drip nozzles (285). According to various embodiments, the breathable medium heat exchanger (210) may be configured for use on existing vapor compression refrigeration systems. That is, both the first heat exchanger (120) and this second heat exchanger (210) may be configured for use on existing refrigeration systems with little or no modification to the original system. Alternatively, refrigeration systems may be designed specifically for use with one or more of the presently described heat exchangers.

Figure 3:
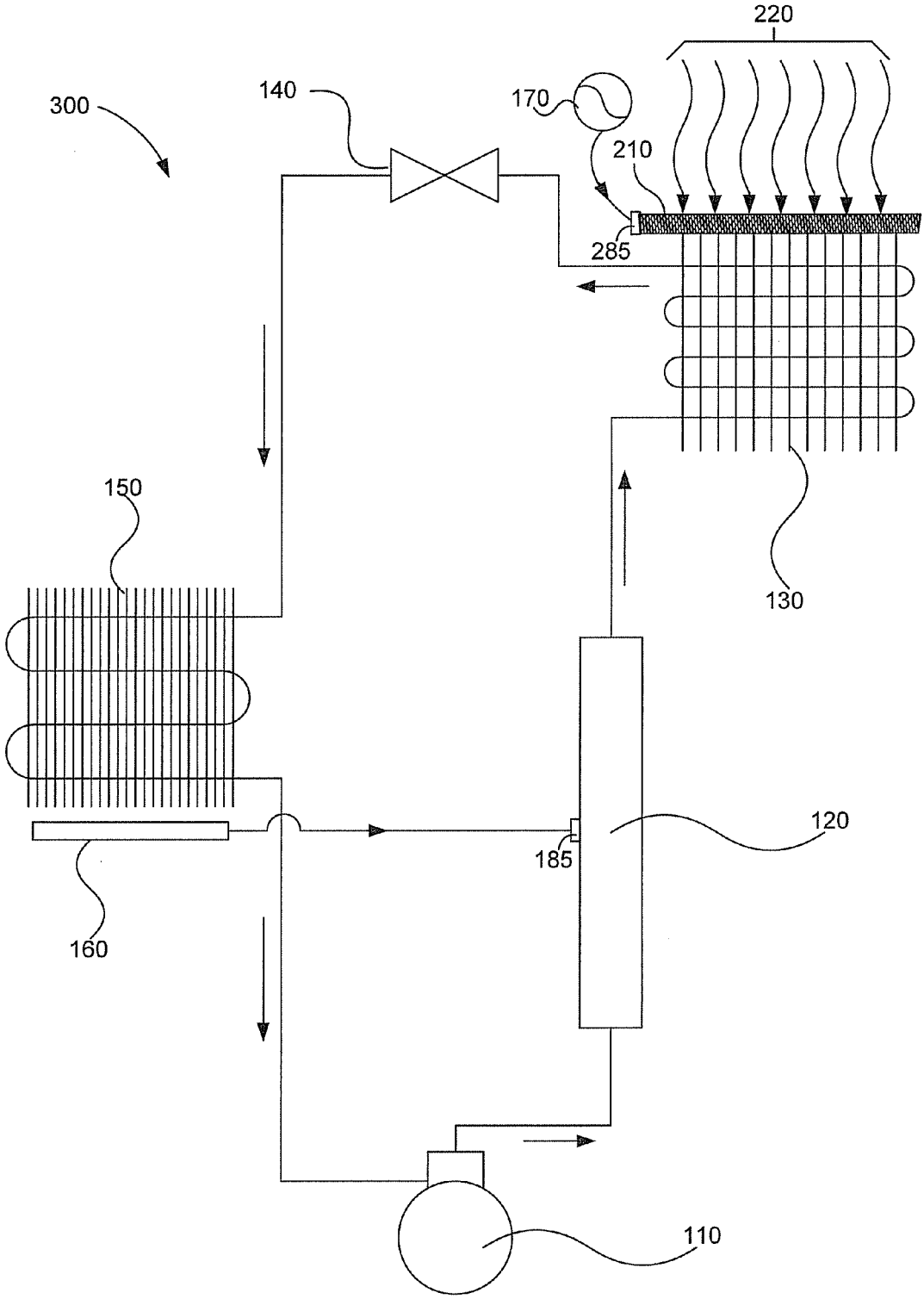
FIG. 3 is a schematic illustrating a vapor compression cycle including a single stage heat exchanger prior to the condenser as well as a convection heat exchanger on the condenser, according to one exemplary embodiment.

FIG. 3 illustrates a third configuration of a vapor compression refrigeration system incorporating a first heat exchanger (120) and a second heat exchanger similar to the one described in conjunction with FIG. 2. As illustrated in FIG. 3, according to one exemplary embodiment, the first heat exchanger (120) includes only one stage and is fed by at least one dripper (185). According to various embodiments, the single stage heat exchanger (120) cools a section of pipe immediately following the compressor (110) and increases the efficiency of the overall system (300) and extends the compressor's life. According to one embodiment of the present system and method including a single stage heat exchanger (120), water is supplied to the heat exchanger (120) by one or more sources. As illustrated in FIG. 3, recovered (160) condensate supplies the cold water to the heat exchanger (120). According to alternative embodiments rainwater and/or city water supply cold water to the first heat exchanger (120).

Throughout FIGS. 1-3 either one or two drippers (185, 285) have been illustrated as supplying water to the variously configured heat exchangers (120, 210). According to various alternative embodiments, a plurality of drippers (185, 285) supplies any number of heat exchangers. For example, while the first heat exchanger (120, FIG. 1) is described as having two stages, each fed by one dripper (185), it is entirely conceivable that each stage may be fed by any number of appropriately sized drippers. In fact, it may beneficial to place multiple drippers as opposed to a single dripper as it may allow a more even distribution of water throughout either the breathable medium (215, FIG. 2) or the water-retaining medium (420, FIG. 4).

Each of the preceding diagrams illustrates a configuration of a vapor compression refrigeration system (100, 200, 300) and where the presently described heat exchangers (120, 210) can be placed to improve efficiency and life of the system (100, 200, 300), according to various embodiments. However, it should be noted that many alternative configurations are possible. The presently described heat exchangers (120, 210) may be positioned at any place within the system (100, 200, 300) and may be various sizes. Particularly, according to various embodiments, the first heat exchanger (120) and/or the second heat exchanger are configured to directly cool the hot pipe portion of the compressor (110), as this is often the hottest component in the system. Furthermore, more than one of each type of heat exchanger may be used in a system to obtain maximum efficiency.

First Heat Exchanger

Figure 4A:
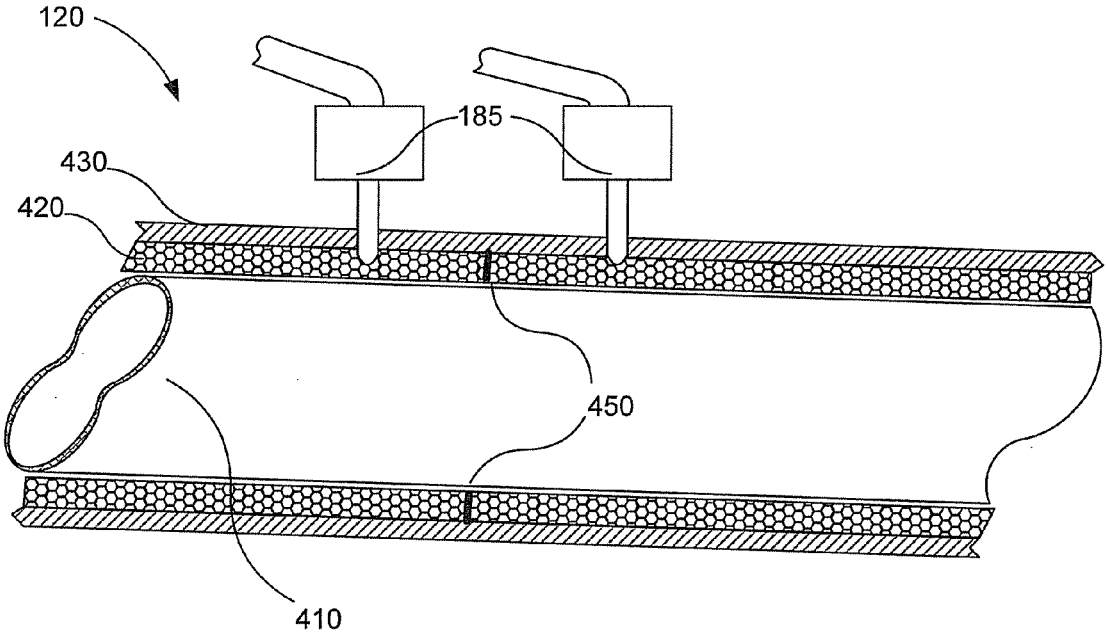
FIGS. 4A and 4B are illustrations of a two-stage heat exchanger configured to surround a section of pipe, according to one exemplary embodiment.
Figure 4B:
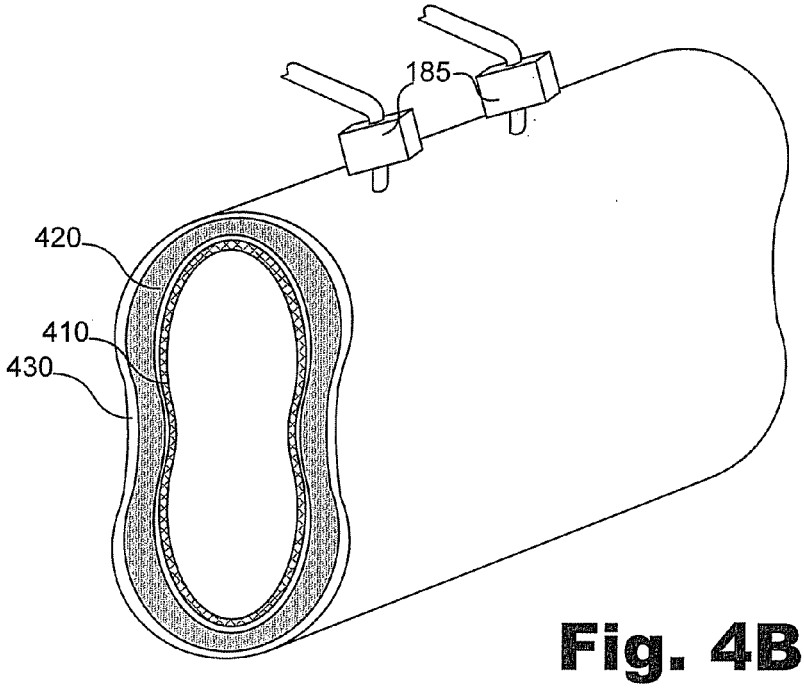

FIGS. 4A and 4B illustrate one exemplary embodiment of the heat exchanger (120) described in FIGS. 1 and 2. According to one embodiment, the first heat exchanger (120) includes a water-retaining material (420), a waterproof layer (430), and one or more drippers (185). The heat exchanger (120) surrounds a section of pipe (410) that is cooled as cold water enters the water-retaining material (420) through the drippers (185). The water-retaining material (420) forces the cold water to come into direct contact with the section of tubing or pipe (410). According to one embodiment, and as illustrated, the section of tubing or pipe (410) may be of any shape, including circular, rectangular, double elliptical, or clover shaped. A tubing whose cross sectional area is small compared to its cross sectional perimeter will allow for maximum heat exchange and is therefore ideal. However, any shape of tubing may be used in conjunction with the presently described heat exchangers.

As illustrated in FIGS. 4A and 4B, the water-retaining material (420) will force cold water to contact the pipe (410). According to various embodiments, the pipe (410) is so hot that the water is flash evaporated. According to one embodiment of the first heat exchanger (120), the waterproof layer (430) will allow water vapor to easily escape, while retaining the colder liquid water within. According to one embodiment, the first heat exchanger (120) retains the evaporated water within the heat exchanger (120) allowing it to become superheated. As the water becomes superheated the pressure within the first heat exchanger (120) increases and, according to one embodiment, is released at a predetermined pressure threshold.

FIGS. 4A and 4B illustrate the first heat exchanger (120) as having two stages. According to one embodiment, a barrier (450) divides the heat exchanger (120) into two stages. According to an alternative embodiment, the two stages are entirely separate from one another. While FIGS. 4A and 4B illustrate only two drippers (185), one for each stage, any number of drippers (185) may be used. Additionally, the flow rate of the drippers may be any number of gallons per hour as is determined necessary. In fact, according to one exemplary embodiment, the flow rate is adjusted dynamically as more water is needed. The flow rate may be adjusted electrically and be based on internal temperature or amount of water within the heat exchanger, or it may be adjusted automatically based on the internal pressure. That is, a dripper may have a variable drip rate depending on the internal pressure. According to one exemplary embodiment, the barrier (450) is removed and recovered condensate from one set of drippers is mixed freely with rainwater and/city water from another set of drippers.

Insulated Heat Exchanger

Figure 5:
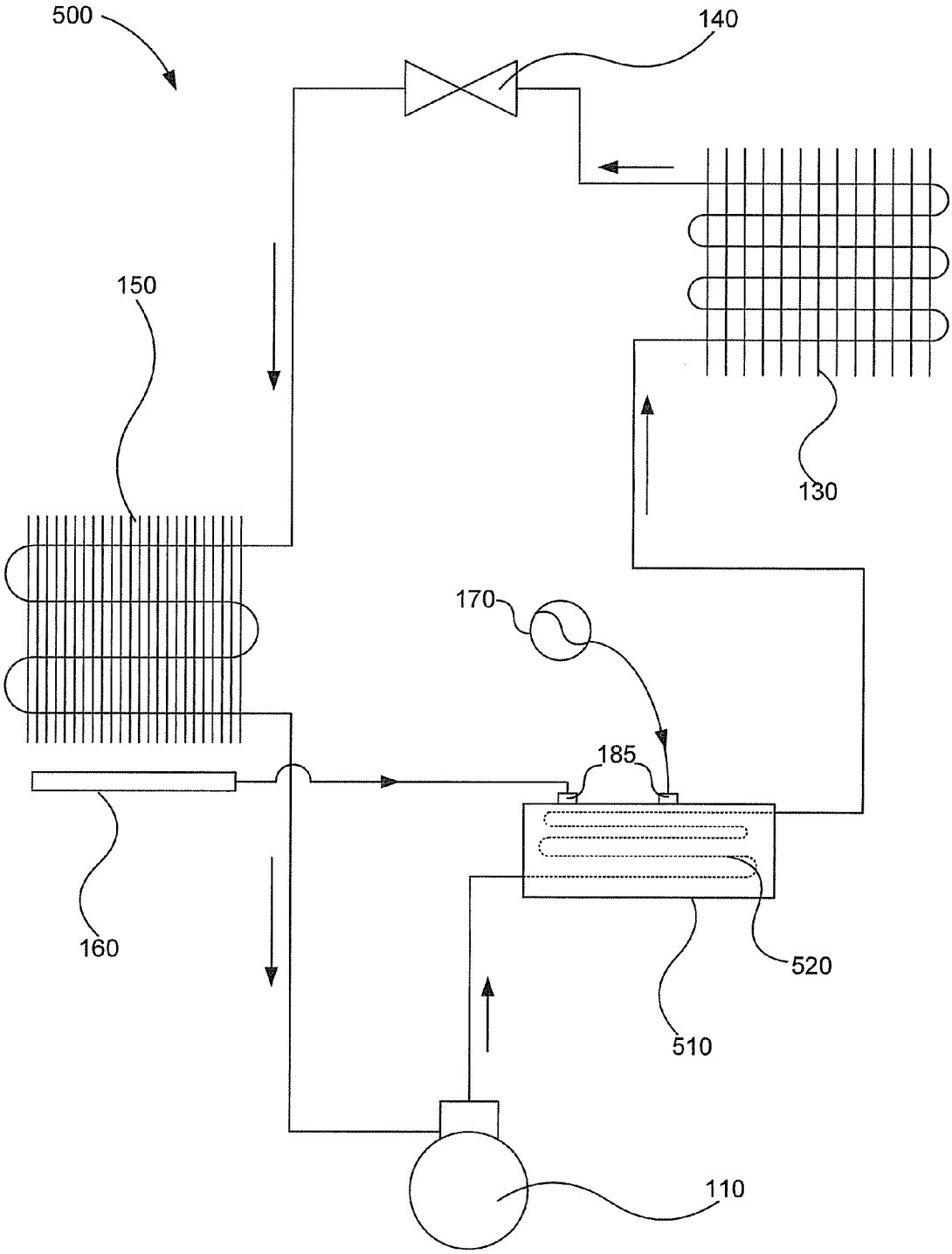
FIG. 5 is a schematic illustrating a vapor compression cycle including an insulated heat exchanger, according to one exemplary embodiment.

FIG. 5 illustrates a schematic of a vapor compression refrigeration system (500) according to one exemplary embodiment. As illustrated in FIG. 5 an insulated heat exchanger (510) directs recovered condensate, rainwater, and/or city water into an insulated enclosure (510). Within the insulated enclosure the tubes containing warm refrigerant pass through several coils (520). Additionally, fins may be configured on the coils (520) to allow for maximum heat exchange. This third heat exchanger is described in greater detail in conjunction with FIG. 7.

Figure 6:
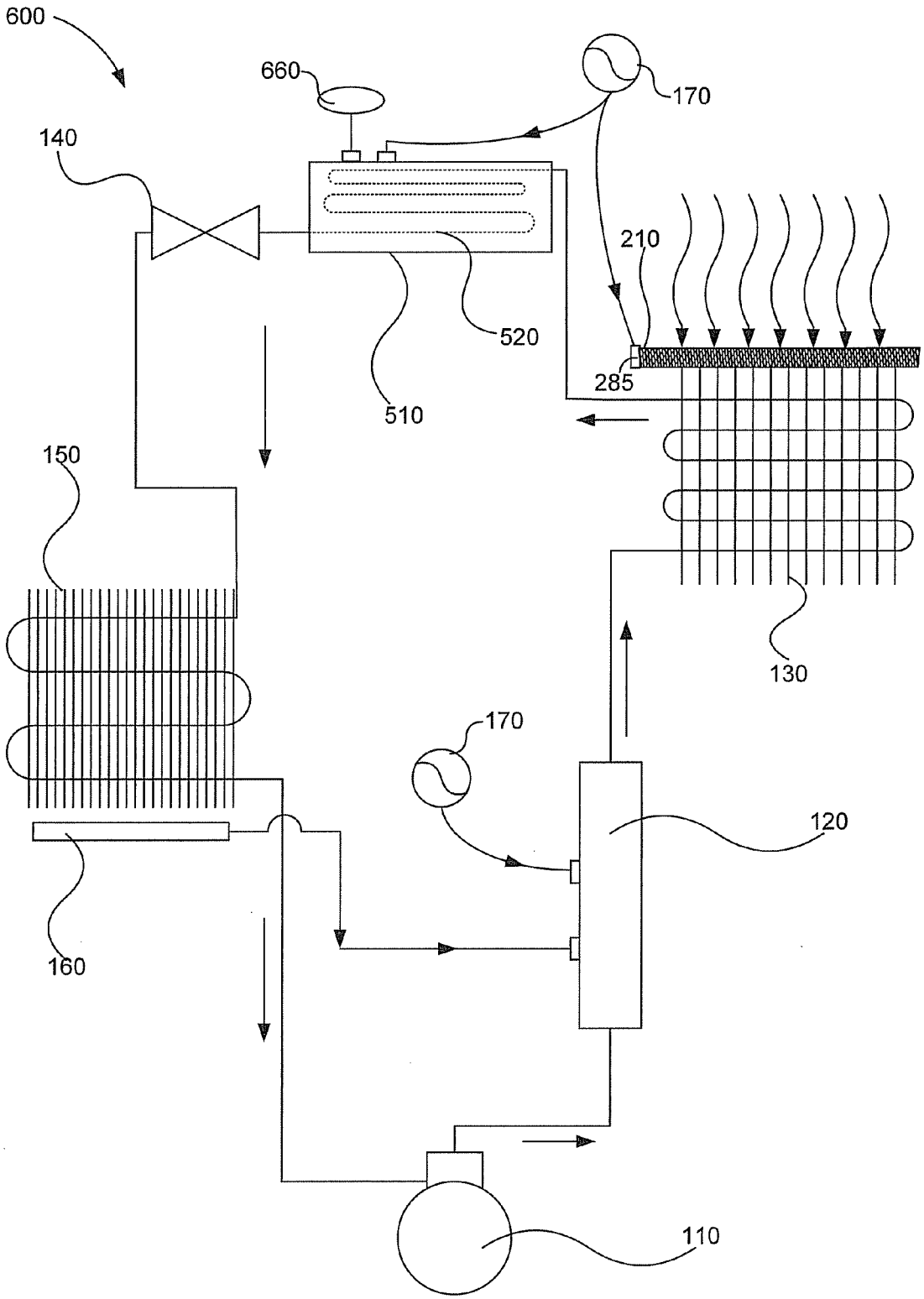
FIG. 6 is a schematic illustrating a vapor compression cycle including a two-stage heat exchanger, a convection heat exchanger, and an insulated heat exchanger, according to one exemplary embodiment.

FIG. 6 illustrates another schematic where all three of the previously described heat exchangers (120, 210, 510) are configured for simultaneous use in a vapor compression refrigeration system (600). According to this embodiment, a first heat exchanger (120) similar to the one illustrated in FIG. 4 cools a section of pipe immediately following the compressor (110). A second heat exchanger (210) provides convection cooling of the condenser (130), similar to that described in conjunction with FIG. 2. Finally, a third, insulated heat exchanger (510) immediately precedes the expansion valve (140). According to this embodiment, the first and second heat exchangers (120, 210) provide similar benefits to those previously described. The third heat exchanger (510) provides additional cooling before the compressed refrigerant enters the evaporator (150) and expands. Similar to previous embodiments, a tray (160) recovers condensate from the evaporator (150) and feeds it through drippers (185) into the first heat exchangers (120, 210). According to one embodiment, the recovered condensate is also fed into the insulated enclosure (510) via a dripper or valve (660). The insulated enclosure (510), similar to the other heat exchangers (120, 210) may receive supplemental water from either collected rainwater and/or city water (170).

Each of the previously described heat exchangers is described as receiving water from one or more sources. According to various embodiments, each of the three heat exchangers (120, 210, 510) receives water from recovered condensate, rainwater, and/or city water. Furthermore, while FIG. 6 illustrates the heat exchangers placement within one exemplary vapor compression refrigerant system (600), many alternative configurations are possible. A person with ordinary skill in the art will recognize that any number of any of the three heat exchangers (120, 210, 510) can be utilized at any location within the system (600).

Figure 7A:
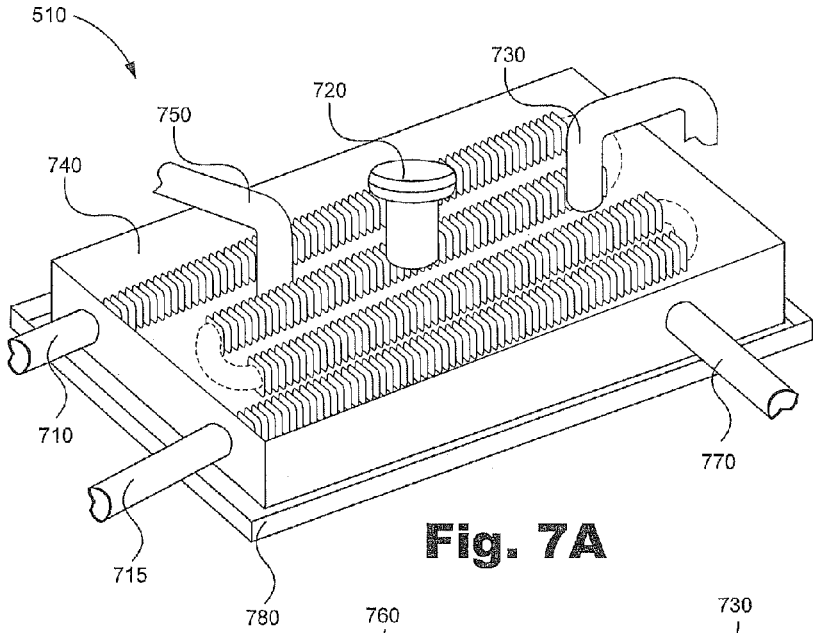
FIG. 7A is an illustration of an insulated heat exchanger with an internal view of the coils, according to one exemplary embodiment.

FIG. 7A illustrates an insulated heat exchanger (510), according to one exemplary embodiment. As is illustrated, an insulated enclosure (740) receives (710) warm refrigerant from the condenser (130, FIG. 6), passes the refrigerant through a series of coils (shown in dashes), and then returns (715) the cooler refrigerant to the expansion valve (140, FIG. 6). As the refrigerant passes through the series of coils, cold water within the enclosure (510) cools the refrigerant before releasing it to the expansion valve (140, FIG. 6). Cold water enters the enclosure (740) through an inlet (750). According to one exemplary embodiment, the inlet (750) receives water from recovered condensate, rainwater, and/or city water. The cold water enters the enclosure (740) and comes into direct contact with the coils of pipes (shown in dashes) and thereby cools them through conduction. The insulated heat exchanger (510) is configured with an emergency overflow pan (780) as well as an emergency overflow outlet (730). Both the pan (780) and the outlet (730) direct water to a suitable location.

According to one embodiment, cold water, after passing over the coil, is directed out of the insulated enclosure (740) to other locations where it can be utilized via the cold-water outlet (770). According to various embodiments, the insulated enclosure (740) also includes a pressure relief (720) valve. In the event the water becomes heated to the point of evaporation, the steam is released via the pressure relief (720).

Figure 7B:
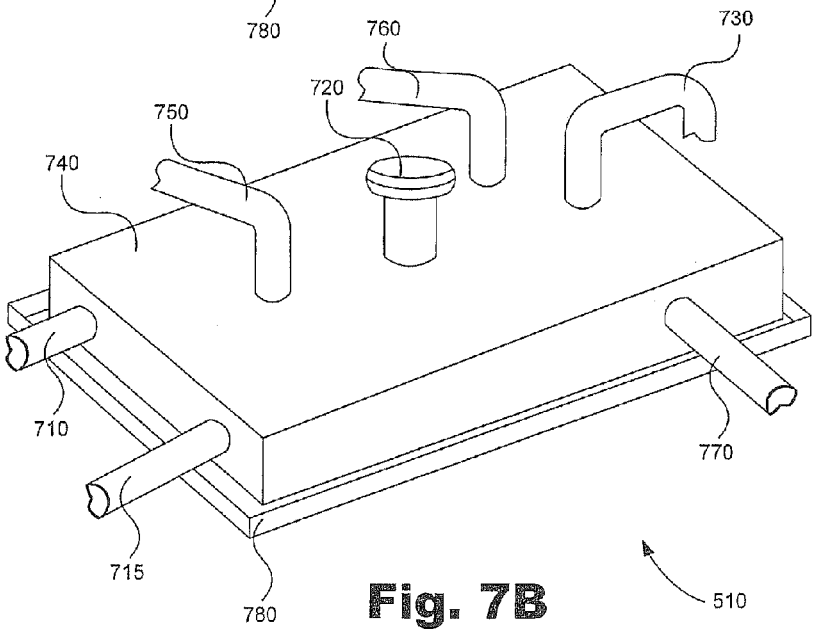
FIG. 7B is an illustration of an insulated heat exchanger that receives water from recovered condensate as well as a secondary source, according to one exemplary embodiment.

FIG. 7B is nearly identical to FIG. 7A except the inner coils are not illustrated and a second supplemental inlet (760) is present. A second inlet (760) allows a supplemental water source to provide cold water in the event that the water source of the first inlet (750) is insufficient. An insulated heat exchanger (510) provides several advantages over the prior art. Most notably, because it is insulated, the ability of the heat exchanger to reject heat is not affected by the ambient temperature of the overall system. In prior art systems the ambient temperature has a severe impact on the ability of heat exchangers to reject heat. The present system and method is affected little by the ambient temperature because the housing is insulated (740).

According to various embodiments, the insulated heat exchanger (510) receives a signal from either within the volume to be cooled or from within the system itself indicating that the valves controlling the inlets (750, 760) should be opened. This prevents water from being wasted when the system is not in use. In a similar manner, all three heat exchangers may receive electrical or mechanical signals to start and stop water flow. Consequently, when the system is not in use, no water will flow.

Exemplary Method

Figure 8:
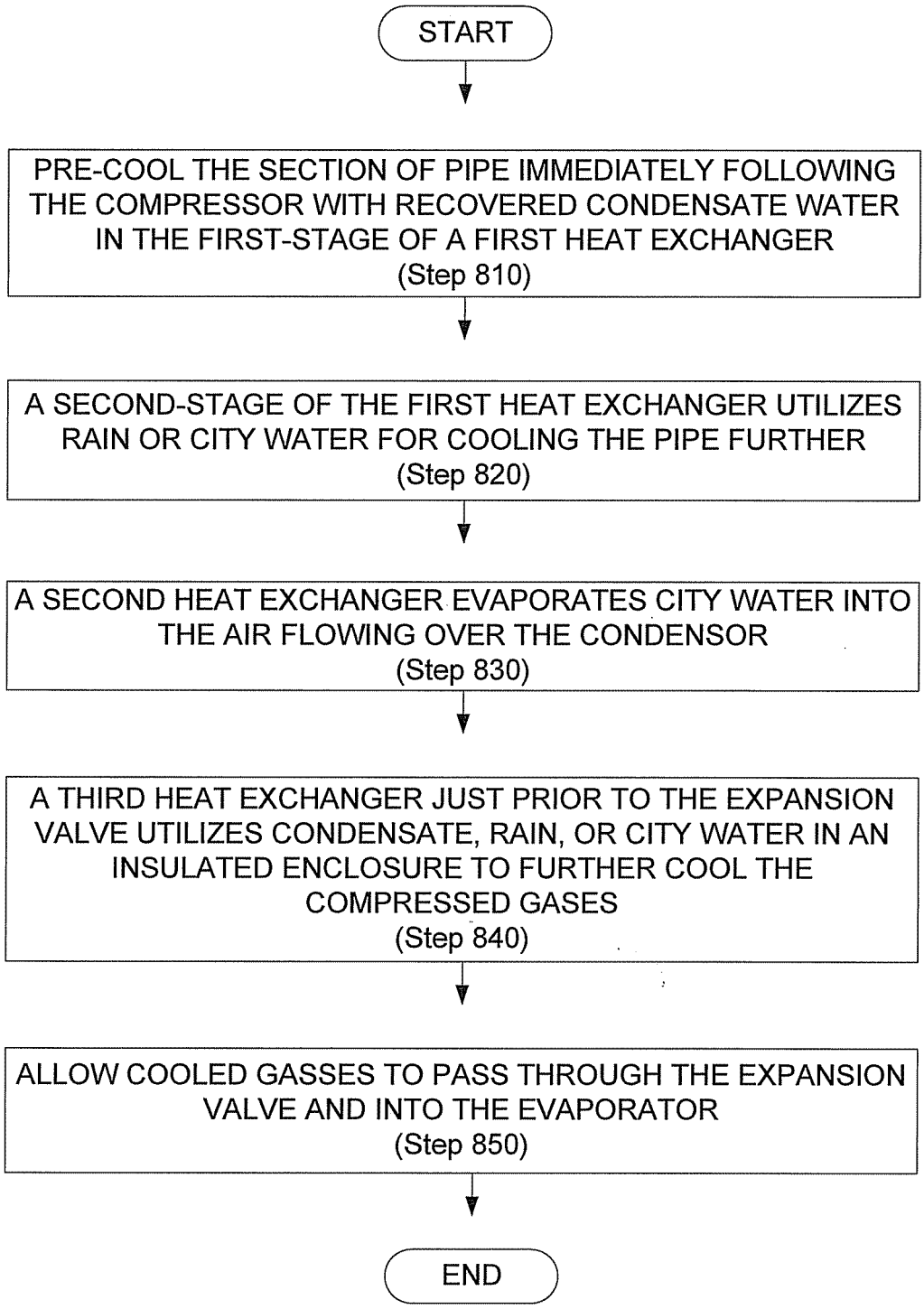
FIG. 8 is a flow chart illustrating a method for a more efficient vapor compression cycle incorporating one or more heat exchangers, according to various exemplary embodiments.

FIG. 8 is a flow chart illustrating one exemplary method improving the efficiency of vapor compression refrigeration systems. In addition, the method described in the flow chart of FIG. 8 extends the life of the compressor because the heat exchangers relieve some of the typical pressure and heat. The following method assumes an understanding of a typical Carnot cycle-based vapor compression refrigerant system. Using FIG. 6 as a reference, a typical system includes a compressor (110), a condenser (130), an expansion valve (140), and an evaporator (150).

A first step (Step 810) to improving the efficiency is to pre-cool the section of pipe immediately following the compressor (110) with recovered condensate collected from the evaporator (150) by a collection tray (160). According to one exemplary embodiment, this initial pre-cooling is done with a first heat exchanger (120) described in conjunction with FIG. 4. According to an alternative embodiment, this pre-cooling is done with an insulated heat exchanger (510) described in conjunction with FIG. 7.

A second step (Step 820) further cools the section of pipe immediately following the compressor (110) by including a second stage within the first heat exchanger (120) that utilizes rainwater and/or city water to absorb and reject additional heat. Alternatively an insulated heat exchanger (510) may also receive rain and/or city water to provide a second stage of cooling. According to another embodiment, a first insulated enclosure provides initial cooling and a second heat exchanger, either that of FIG. 4 or FIG. 7, provides additional cooling to the section of pipe.

Another heat exchanger (210) allows forced air to evaporate condensate, rainwater, and/or city water into forced air before passing it over the condenser (130) (Step 830). As cold water is evaporated into the air in this heat exchanger, the air will lower in temperature. The cold air absorbs more heat from the condenser (130). Furthermore, humid air allows for better heat absorption than the previous dry air.

Finally, after the condenser (130), a third heat exchanger (FIG. 7) provides further cooling by passing the condensed refrigerant through coils within an insulated enclosure (740, FIG. 7) (Step 840). The insulated heat exchanger (510) allows cold condensate, rainwater, and/or city water to directly contact and cool the coils of refrigerant. The insulated enclosure (740) allows heat to be rejected independent of the ambient temperature. Often, the ambient temperature of prior art systems is so high that little heat can be rejected. The larger the temperature difference between the cooling air or water and the hot refrigerant, the more heat will be rejected. By maintaining the cold water within the insulated enclosure, a maximum difference in temperature between the water and the hot refrigerant is preserved.

Finally (Step 850) the cooled refrigerant passes through the expansion valve (140) and into the evaporator (150) where it provides cooling for the intended volume. As is apparent to one of ordinary skill in the art, any of the previous steps may be done exclusive of the other steps, or in an alternative order and still achieve superior efficiency over the prior art. Any of the described heat exchangers may be used in conjunction with any other heat exchangers or exclusive of them in any location within a typical vapor compression refrigeration system. According to various embodiments, the heat exchangers described herein may be configured for easy attachment to existing refrigeration systems. Alternatively, a system may be specifically designed to take advantage of the systems and methods described herein.

The preceding description has been presented only to illustrate and describe embodiments of the principles described herein. It is not intended to be exhaustive or to limit the disclosure to any precise form. The principles described herein may be practiced otherwise than is specifically explained and illustrated without departing from their spirit or scope. For example, the principles described herein may be implemented in a wide variety of refrigeration systems, including, but not limited to, refrigerators, freezers, air conditioning units, and other Carnot cycle-based systems that reject heat. It is intended that the scope of the present exemplary system and method be defined by the following claims.

What is claimed is:

1. A vapor compression refrigeration system comprising: a compressor; a condenser; an expansion valve; an evaporator; hermetically sealed tubing containing refrigerant connecting said compressor, condenser, expansion valve, and evaporator; and a first heat exchanger that cools a section of tubing immediately following the compressor to effectively cool the compressor; wherein said first heat exchanger has a first stage and a second stage; wherein the cooling fluid in said second stage is one of city water and collected rainwater.

2. The system of claim 1, wherein said first heat exchanger surrounds said section of tubing and comprises: a water-retaining medium; and a waterproof layer; wherein the water-retaining medium in both the first stage and the second stage is drip fed water through one or more drippers; wherein the one or more drippers allow the controlled release of water to the heat exchanger; and wherein the water-retaining medium maintains water directly surrounding and contacting the outer circumference of the section of tubing.

3. The system of claim 2, wherein the water source of said one or more drippers feeding the first stage is one or more of either condensate recovered from the evaporator, collected rainwater, or city water, and wherein the water source of said one or more drippers feeding the second stage is one of collected rainwater and city water.

4. The system of claim 1, wherein said first heat exchanger is configured to be adapted for use on existing refrigeration systems.

5. The system of claim 3, further comprising a second heat exchanger wherein said second heat exchanger comprises a water-retaining breathable medium and wherein air is forced through said breathable medium and over said condenser of said refrigeration system.

6. A vapor compression refrigeration system comprising: a compressor; a condenser; an expansion valve; an evaporator; hermetically sealed tubing containing refrigerant connecting said compressor, condenser, expansion valve, and evaporator; a first heat exchanger that cools a section of tubing immediately following the compressor to effectively cool the compressor; wherein said first heat exchanger surrounds said section of tubing and comprises: a water-retaining medium; and a waterproof layer; wherein the water-retaining medium is drip fed water through one or more drippers; wherein the water source of said one or more drippers is one or more of either condensate recovered from the evaporator, collected rainwater, or city water; and a second heat exchanger wherein said second heat exchanger comprises a water-retaining breathable medium and wherein air is forced through said breathable medium and over said condenser of said refrigeration system.

7. The system of claim 3, further comprising a second heat exchanger wherein said second heat exchanger comprises an insulated enclosure; wherein said insulated enclosure causes cold water to directly contact a section of said refrigerant-containing tubing.

8. The system of claim 7, wherein said cold water within said insulated enclosure is supplied by one or more of condensate recovered from said evaporator, collected rainwater, or city water.

9. The system of claim 8, wherein said second heat exchanger cools a section of refrigerant-containing tubing between said condenser and said expansion valve.

10. The system of claim 9, further comprising a third heat exchanger wherein said third heat exchanger comprises a water-retaining breathable medium and wherein air is forced through said breathable medium and over said condenser of said refrigeration system.

11. A heat exchanger configured to cool refrigerant within a vapor compression refrigeration system, comprising: an insulated enclosure; an inlet configured to receive hot refrigerant; a coil of tubing within said insulated enclosure configured to route said hot refrigerant through said insulated enclosure prior to returning said refrigerant to said system; and a plurality of cold water inlets; wherein said cold water is configured to pass over said coil of tubing containing hot refrigerant and cool said hot refrigerant; and wherein at least one of the plurality of cold water inlets provides water from condensate and at least one of the plurality of cold water inlets provides water from one of collected rainwater and city water.

12. The heat exchanger of claim 11, further comprising a pressure relief valve configured to release superheated water vapor within said enclosure at a predetermined pressure.

13. The heat exchanger of claim 12, further comprising an overflow pan configured to capture any water that escapes said enclosure.

14. The heat exchanger of claim 13, further comprising an overflow outlet configured to release excess water within said insulated enclosure.

15. The heat exchanger of claim 11, wherein said coil is further configured with fins to accelerate heat transfer between said cold water and said coil of hot refrigerant.

16. The system of claim 6, wherein said water-retaining breathable medium is fed water from a water source comprising one or more of condensate recovered from the evaporator, collected rainwater, or city water.

17. A vapor compression refrigeration system comprising:

a compressor;

a condenser;

an expansion valve;

an evaporator;

hermetically sealed tubing containing refrigerant connecting said compressor, condenser, expansion valve, and evaporator;

a first heat exchanger that cools a section of tubing immediately following the compressor to effectively cool the compressor;

wherein said first heat exchanger surrounds said section of tubing and comprises:

a water-retaining medium; and a waterproof layer;

wherein the water-retaining medium is drip fed water through one or more drippers;

wherein a water source of said one or more drippers is one or more of either condensate recovered from the evaporator, collected rainwater, or city water;

a second heat exchanger that comprises an insulated enclosure;

wherein said insulated enclosure causes cold water to directly contact a section of said refrigerant-containing tubing;

wherein said cold water within said insulated enclosure is supplied by one or more of condensate recovered from said evaporator, collected rainwater, or city water;

wherein said second heat exchanger cools a section of refrigerant-containing tubing between said condenser and said expansion valve; and a third heat exchanger comprising a water-retaining breathable medium and wherein air is forced through said breathable medium and over said condenser of said refrigeration system.

* * * * *